United States Patent [19]

Sunaga

[11] Patent Number: 4,579,029

[45] Date of Patent: Apr. 1, 1986

[54] ELECTRIC PUNCH

[75] Inventor: Tadao Sunaga, Narashino, Japan

[73] Assignee: Maruzen Kabushiki Kaisha, Tokyo, Japan

[21] Appl. No.: 641,269

[22] Filed: Aug. 16, 1984

[30] Foreign Application Priority Data

Aug. 22, 1983 [JP] Japan ..... 58-152876

[51] Int. Cl.[4] ..... B26D 5/08

[52] U.S. Cl. ..... 83/364; 83/372; 83/551; 83/575; 83/588

[58] Field of Search ..... 83/575–577, 83/167, 467 R, 467 A, 468, 550, 551, 555, 370, 372, 364, 588

[56] References Cited

U.S. PATENT DOCUMENTS

| | | | |
|---|---|---|---|
| 2,327,646 | 8/1943 | Hutchinson | 83/550 |
| 3,182,905 | 5/1965 | Rabinow | 83/577 X |
| 3,427,914 | 2/1969 | Staats | 83/467 R |
| 4,421,000 | 12/1983 | Murphy | 83/372 |

FOREIGN PATENT DOCUMENTS

| | | | |
|---|---|---|---|
| 610592 | 10/1960 | Italy | 83/575 |

*Primary Examiner*—James M. Meister
*Assistant Examiner*—John L. Knoble
*Attorney, Agent, or Firm*—James E. Nilles

[57] ABSTRACT

An electric punch wherein lower blades each are formed in the bottom part of each insertion concavity into which sheets of paper being punched are inserted sideways, and a plurality of elevatable upper blades are formed, each upper blade being lowered into the corresponding lower blade by a solenoid excited in sequence.

4 Claims, 5 Drawing Figures

ELECTRIC PUNCH

BACKGROUND OF THE INVENTION

1. Field of the Invention

The present invention relates to an electric punch, and in particular to an electric punch which punches a plurality of filing holes in sheets of paper stacked to a prescribed thickness or in a single sheet of paper of that prescribed thickness.

2. Description of the Prior Art

A variety of constructions of an electric punch which punches a plurality of filing holes in sheets of paper have been proposed heretofore.

However, in the constructions proposed so far, for instance in a construction in which a plurality of solenoids are employed and a punching blade for each solenoid is lowered simultaneously with the others, each solenoid consumes a large quantity of current rapidly, which results in the problems that an extremely large total current is required, and that noise is generated.

In another conventional construction, punching blades fitted directly to the plungers of a plurality of solenoids are lowered to punch holes in a stack of paper. With this construction, a force of about 65 kg could be needed for punching holes of diameter of about 7 mm in 30 sheets of ordinary thickness paper, which results in problems concerning punching force and the mechanism required for obtaining this force.

SUMMARY OF THE INVENTION

An object of the present invention is to provide an electric punch in which a plurality of solenoids are excited in sequence with staggered timing, elevating arms, each of a prescribed leverage, are operated by the force of attraction of the solenoids and a hammer-impact force is generated by the rapid acceleration of the plungers of the solenoids, and punching blades are raised and lowered by the elevating arms, so that the required punching force can be obtained by a punch with a simple construction, while the generation of an extremely large current and noise, etc., can be prevented.

Another object of the present invention is to provide an electric punch in which the force of repulsion of the elevating arms when raising and lowering the punching blades is increased to prevent the paper catching against the blades after the punching, to enable a sure and smooth separation of the blades from the sheets of paper.

The electric punch of the present invention is characterized in that it is equipped with a punching block which has a plurality of insertion concavities into which sheets of paper being punched are inserted, a lower blade being formed in the bottom part of each insertion concavity; a plurality of elevatable upper blades, each of which can be raised from and lowered into a corresponding lower blade; a plurality of elevating arms provided rotatably, one for each upper blade, with one end supported axially by the punching block, so as to raise and lower the corresponding lower blade; a plurality of solenoids each provided with a plunger fitted rotatably one to the other end of each elevating arm; and a control mechanism which is operated by the insertion of sheets of paper into the insertion concavities of the punching blocks, and which controls the solenoids so that they are excited in sequence.

The electric puncher of the present invention is also characterized in that it is equipped with a plurality of punching blocks each provided with an insertion concavity into which sheets of paper being punched are inserted, a lower blade being formed in the bottom part of said insertion concavity; an elevatable upper blade which can be raised from and lowered into each lower blade; an elevating arm provided rotatably, with one end supported axially by each punching block, so as to raise and lower the corresponding upper blade; a plurality of solenoids each provided with a plunger fitted rotatably to the other end of each elevating arm; the control mechanism provided with a switching mechanism which is closed by the insertion of sheets of paper into the insertion concavities of the punching blocks, and which controls the solenoids so that they are excited in sequence by the closing of the switching mechanism; and a return means interposed between each of the punching blocks and the corresponding elevating arm, which rotates the elevating arm to return it so that the upper blade is raised forcedly after the punching when the solenoid is released from its excitation.

Other objects and characteristics of the present invention will be disclosed hereunder, with reference to the accompanying drawings.

BRIEF DESCRIPTION OF THE DRAWINGS

The figures show one embodiment of the present invention.

DESCRIPTION OF THE PREFERRED EMBODIMENT

Figure 1:
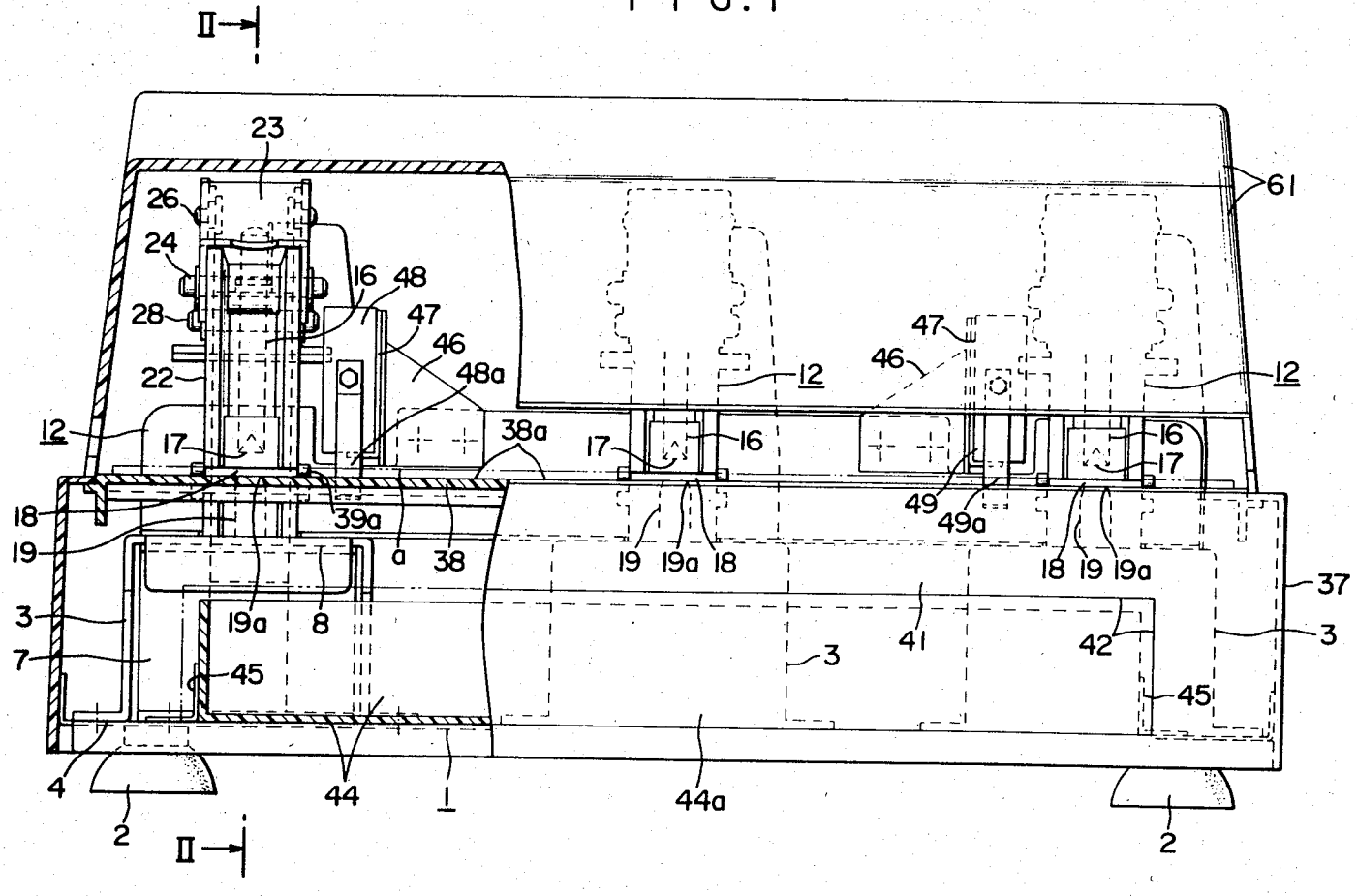
FIG. 1 is a front view of a partially-cutaway electric punch.
Figure 2:
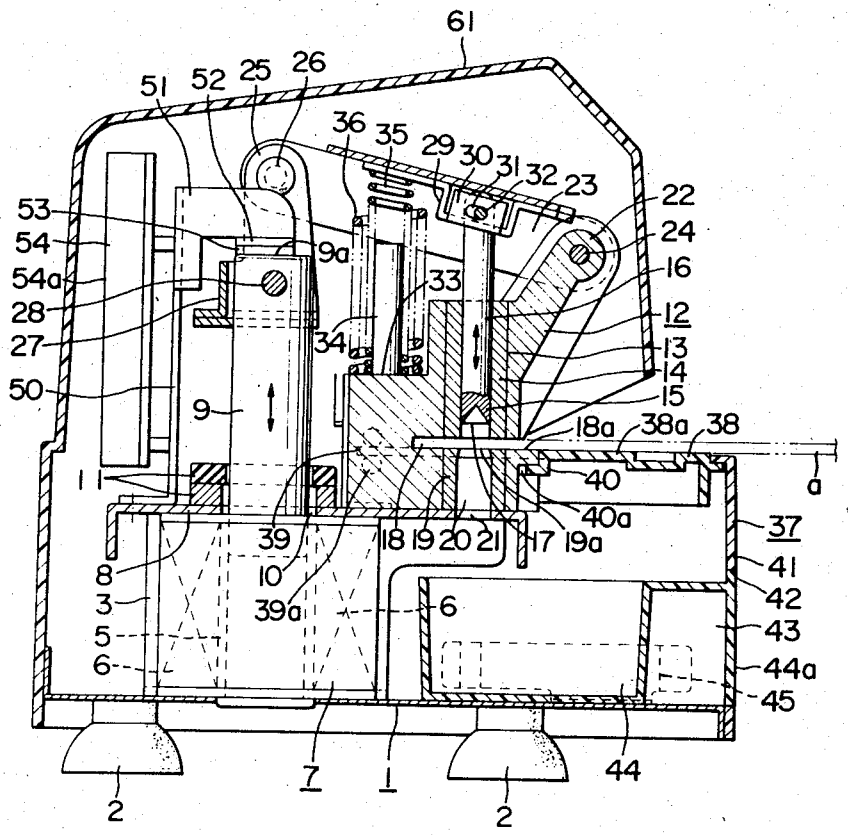
FIG. 2 is a section thereof taken along the line II—II of FIG. 1.
Figure 3:
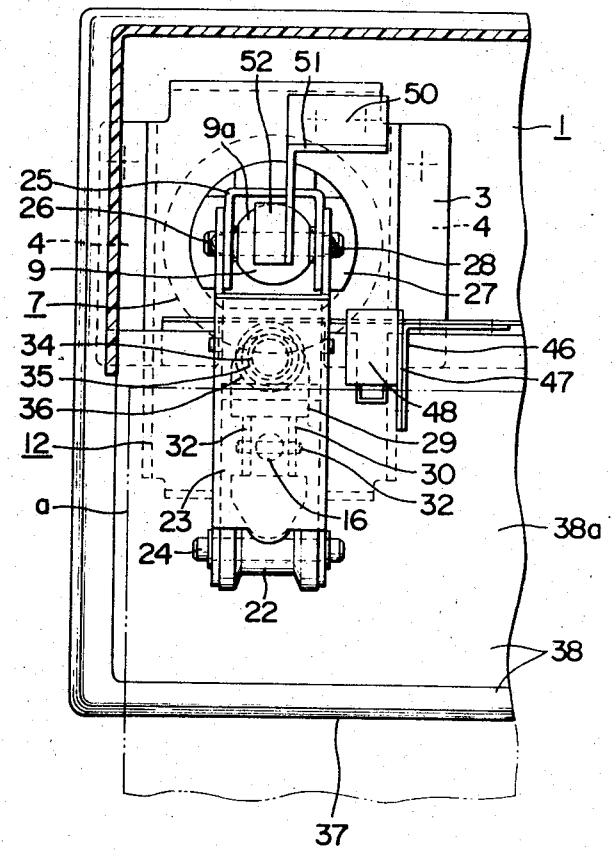
FIG. 3 is a plan view of a partially-cutaway part thereof.
Figure 4:
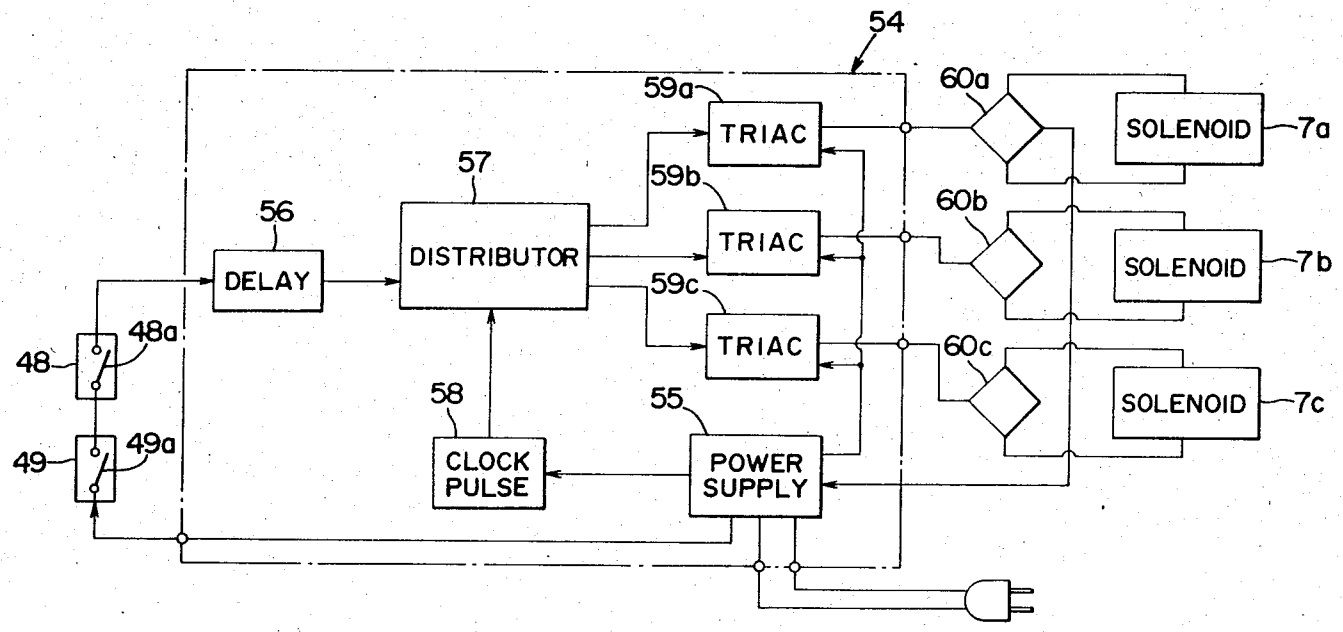
FIG. 4 is an operational block diagram of the solenoids thereof.
Figure 5:
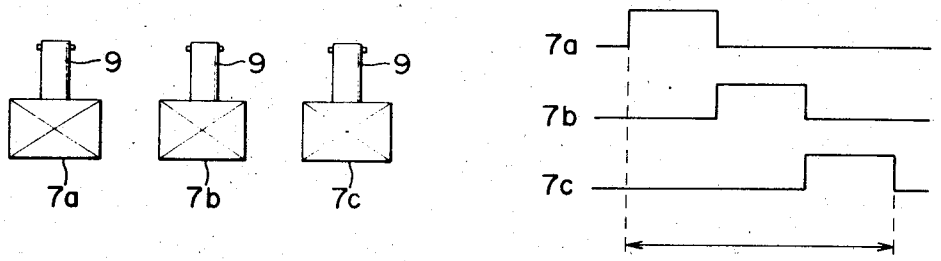
FIG. 5 shows the solenoids and the operational waveforms thereof.

In the figures, numeral (1) denotes a main body base provided with a plurality of feet formed of rubber or the like, and a plurality of solenoid-mounting frames (3) are fixed integrally in the rear part of the main body base (1) by cushions (4) in such a manner that they are arranged at prescribed intervals laterally, when viewed from the front. A solenoid (7) formed by winding a coil (6) around a bobbin (5) is mounted on each of the solenoid-mounting frames (3), a guide hole (10) through which a plunger (9) of the solenoid (7) is raised and lowered is made in a mounting board (8) provided integrally with the top of each solenoid-mounting frame (3), and a cushion member (11) is fixed integrally to the opening edge of each guide hole (10).

A punching block (12) is attached to the front of each mounting board (8). Each punching block (12) is provided with a mounting hole (13) bored there through in the vertical direction, and a hollow cylindrical guide member (14) is inserted integrally into each mounting hole (13). A rod-shaped punching blade member (16) is inserted slidably into a slide hole (15) in each guide member (14), and a conical upper blade (17) is formed at the lower end of each blade member (16). It is desirable that this upper blade (17) is shaped so that its section has an opening angle of about 75 degrees, although the shape of the upper blade employed in practice could be varied slightly according to the quality of the paper being punched, the thickness thereof, and the weather, etc. An insertion concavity (18) into which sheets of paper (a) are inserted is formed horizontally in a lower side part of each punching block (12), deeper than the slide holes (15), with the front side thereof open. A hollow cylindrical lower blade member (19) provided with a lower blade (19*a*) corresponding to the upper blade (17) of the blade member (16) is fitted integrally to the middle of a bearing surface (18*a*) formed by the bottom surface of each insertion concavity (18), in the same plane thereof, and a guide hole (20) communicating with the slide hole (15) is formed in the lower blade member (19). The guide hole (20) also communicates with a waste discharge port (21) formed in each mounting board (8). One end of an elevating arm (23) is pivoted about a support shaft (24) at the upper end of a support arm (22) projecting upward from the front of each punching block (12), so that it can rotate in a vertical plane, and the upper end of a metal connector (25) is attached rotably to a shoulder pin (26) at the other end of the elevating arm (23). The upper end of each plunger (9) fits into a holder (27) provided at the lower end of the metal connector (25), and is connected to its holder (27) by a connection pin (28).

A connection frame (29) is fitted integrally over the back surface of the elevating arm (23), and side plates (30) are provided on the opposite sides of the connection frame (29). Arc-shaped guide grooves (31) are formed in these side plates (30), and the upper end of the blade member (16) inserted through the connection frame (29) is attached rotatably to a connection rod (32) laid horizontally between the guide grooves (31).

An engagement step (33) is formed horizontally on the rear side of each punching block (12), and a spring shaft (34) which is shorter than the distance between the engagement step (33) and the elevating arm (23) is erected monolithically on the step (33). A first coil spring (35) which has a weak spring force is mounted, as a return means, on the spring shaft (34), and the upper end of the first coil spring (35) engages constantly with the rear of the elevating arm (23). A second coil spring (36) acting as another return means and which has a stronger spring force and is shorter than the first coil spring (35) is mounted on the spring shaft (34). The coil springs (36) are designed so that the upper ends thereof are a prescribed distance from the rear surfaces of the elevating arms (23) when the plungers (9) are raised.

The outer periphery of the main body base (1) is covered by a lower panel cover (37). A plurality of engagement portions (39) and (40) formed at the inner edges of a top board (38) of this lower panel cover (37) engage with engagement portions (39*a*) and (40*a*) on each punching block (12), and a loading surface (38*a*) is formed on the surface of the top board (38) so that it is positioned in the same plane as the bearing surfaces (18*a*) of the insertion concavities (18). An outlet port (42) is formed in the front panel (41) of the lower panel cover (37), and a waste receiver (44) which receives the pieces punched out of the sheets of paper from the discharge ports (21) is housed in a housing unit (43) communicating with the outlet port (42), in such a manner that it can be taken out therefrom. The waste receiver (44) is designed so that it can engage removably with resilient engagement pieces (45) provided on the opposite sides of the housing unit (43), and a front plate (44*a*) of the waste receiver (44) is designed so that it is in the same plane as the front panel (41) of the lower panel cover (37).

A switch-mounting board (46) is provided projecting from one side of each of the punching blocks (12) positioned at the opposite ends of the electric puncher, and a first trigger switch (48) and a second trigger switch (49) each constituting a switch mechanism are fitted onto the switch-mounting boards (46) on both sides, over adjustment plates (47). Operational pieces (48*a*) and (49*a*) of the first and second trigger switches (48) and (49), respectively project to positions at which they are pushed open or closed by the front edge of the paper (a) inserted into the insertion concavities (18).

A mounting base board (50) is erected monolithically at the rear side of the mounting board (8) of each solenoid-mounting frame (3), a metal stopper (51) for each plunger (9) is fitted integrally to the upper part of the mounting base board (50), and a cushion member (53) for the top part (9*a*) of each plunger (9) is fixed integrally to the lower surface of an engagement plate (52) of each metal stopper (51).

A control box (54*a*) containing a control mechanism (54) controlling all the solenoids (7) is supported on the mounting base board (50) on one side of the puncher. The control mechanism (54) in the control box (54*a*) is provided with a power supply circuit (55) connected to a commercial power source, the second trigger switch (49) is connected to one end of this power supply circuit (55), and the first trigger switch (48) is connected in series with the second trigger switch (49). A delay circuit (56) is connected to the other end of the first trigger switch, a distribution circuit (57) is connected to the delay circuit (56), and a clock pulse circuit (58) connected to the power supply circuit (55) is connected to the distribution circuit (57). A plurality of triacs (59*a*), (59*b*) and (59*c*) are connected to the distribution circuit (57), and solenoids (7*a*), (7*b*) and (7*c*) are connected to the triacs (59*a*), (59*b*) and (59*c*) by bridge rectifier circuits (60*a*), (60*b*) and (60*c*), respectively. In the figures, numeral (61) denotes an upper panel cover covering the upper part of the apparatus.

Next a description will be made of the operation of the puncher of this construction. A sheet of paper (a) of a prescribed thickness or sheets of paper (a) stacked to the prescribed thickness are placed, as the object to be punched, on the top board (38) of the lower panel cover (37), lined up with marks (not shown in the figures) provided on the front of the top board (38) to indicate the punching position, and then the paper (a) is inserted into the insertion concavities (18) of the punching blocks (12). The paper (a) can be inserted smoothly into each insertion concavity (18), since the bearing surface of each insertion concavity (18) is formed in the same plane as the bearing surface (38*a*) of the top board (38).

When the paper (a) has been inserted deep into the insertion concavities (18), the operational pieces (48*a*) and (49*a*) of the first and second trigger switches (48) and (49) are pushed by each side of the inserted edge of the paper (a), and usually-open contacts of the trigger switches are turned on by the displacement of the operational pieces (48*a*) and (49*a*). When the paper (a) is inserted at an angle, for instance, into the insertion concavities (18), and thus the operational pieces (48*a*) and (49*a*) are not pushed simultaneously by both ends of the inserted edge of the paper (a), i.e. only one of the operational pieces (48*a*) and (49*a*) is pushed, and the first and second trigger switches (48) and (49) are not energized because, they are connected in series.

When both the first and second trigger switches (48) and (49) are turned on, the delay circuit (56) is operated, and the distributor (57) is operated after a short, preset delay after the paper sheets (a) have been inserted into the insertion concavities (18). The interposition of the delay circuit (56) between the first and second trigger switches (48) and (49) and the distributor (57) can prevent erroneous operation of the distributor (57) due to repeated chattering of the paper (a) inserted into the insertion concavities (18), and the first and second trigger switches (48) and (49).

Next, when the distributor (57) is operated, pulses of a prescribed solenoid operation time width set in the clock pulse circuit (58) are fed in sequence to the triacs (59*a*), (59*b*), and (59*c*), and the triacs are turned on in sequence by the output signals from the distributor. Signals generated by the staggered operations of the triacs (59*a*), (59*b*), and (59*c*) are fed to the solenoids (7*a*), (7*b*), and (7*c*) after rectification by the bridge rectifier circuits (60*a*), (60*b*), and (60*c*), respectively, and the solenoids (7*a*), (7*b*) and (7*c*) are excited by these output signals in sequence at the corresponding pulse signals, so that the plungers (9) of the solenoids (7*a*), (7*b*) and (7*c*) are operated to lower in sequence. The lowering of the plungers (9) rotates the elevating arms (23) downward in sequence about the corresponding supporting shafts (24) provided in the support arms (22) of the punching blocks (12), while each rod-shaped blade member (16) connected to the elevating arms (23) is pushed downward by the lowering of its arm. The blade members (16) are slid sequentially through the corresponding slide holes (15) of the punching blocks (12) and are lowered in sequence onto the paper (a). The paper (a) is held between the upper blades (17) of the blade members (16) and the lower blades (19*a*) provided around the opening of the guide holes (20) of the lower blade members (19), and are punched sequentially thereby, each upper blade (17) being inserted into the corresponding guide hole (20) of the lower blade members (19). Consequently, the same number of holes as blade members (16) are punched rapidly, but in steps, in the paper (a) by the blade members (16). During this time, since the first and second coil springs (35) and (36) of different spring forces are interposed between each punching block (12) and its elevating arm (23), each elevating arm (23) is lowered against the weak repulsion force of its first coil spring (35) during an initial lowering operation, and then against the strong repulsion force of the second coil spring (36) during the lowering operation from an intermediate position at which the arm is fully accelerated, as far as the vicinity of the final position. Accordingly, each blade member (16) is lowered rapidly during the initial lowering of its plunger (9), since no large upward bias is initially imparted to the elevating arm (23).

The pieces of the paper (a) punched out by each blade member (16) drop from the discharge port of the lower blade member (19) and are collected in the waste receiver (44) positioned on the main body base (1).

When each of the solenoids (7*a*), (7*b*) and (7*c*) is released from its excitation after the paper (a) has been punched by the lowered blade member (19) thereof, the corresponding elevating arm (23) is immediately pushed up so that it rotates, by the restoring forces of the first and second coil springs (35) and (36) which were compressed by the lowering of the elevating arm (23), while the rod-shaped blade member (16) connected to the elevating arm (23) is extracted from the paper (a) through which it has been thrust, and is pulled up through the slide hole (15) above the insertion concavity (18), and the elevating arm (23) is then pulled up above the second coil spring (36) by the first coil spring (35). When each solenoid is released from its excitation and the corresponding blade member (16) is extracted from the paper after it has been punched, the force with which the paper holds the blade members (16) is strong when there are a large number of sheets of paper (a), or when the paper is thick, or the humidity is high, etc. However, since the first and second coil springs (35) and (36) forming a double spring structure have forces of repulsion strong enough to overcome this obstruction, the blade members (16) are lowered and raised smoothly at all times, and thus can always be extracted from the paper (a). In addition, since the engagement of each blade body (16) with the paper (a) is cancelled by the pulling-up of the blade member (16), the paper (a) can be pulled out easily from the insertion concavities (18), and thus the subsequent punching operation can be prepared for.

In the above embodiment, the description concerned the case in which three solenoids are provided in parallel, and three holes are punched in sheets of paper by three rod-shaped blade members. The present invention is not limited to this case. When it is desired to punch a number of holes more or less than three, it is sufficient to provide a number of solenoids corresponding to the number of holes required. In these cases too, the solenoids are arranged so that they do not operate simultaneously, but operate in sequence.

Effect of the Invention

According to the present invention, a control mechanism is made to operate by sheets of paper simultaneously with the insertion of the paper into insertion concavities of punching blocks, a plurality of solenoids are excited in sequence with staggered timing, upper blades are lowered in sequence according to the excitation of elevating arms connected to plungers of the solenoids, and thereby a plurality of holes can be punched rapidly in the paper. During this time, a force necessary and sufficient for punching the paper by the upper blades can be obtained by a simple construction, since the elevating arms operate at a constant leverage, and the generation of extremely large currents and noise, etc., can be prevented without fail, since the solenoids driving each of the upper blades operate in sequence with staggered timing, in a different manner from a punch in which they operate simultaneously.

In addition, the provision of a return means for each elevating arm makes it possible to raise the upper blade forcibly when its solenoid is released from its excitation after the punching, by using a large force of repulsion against the lowering of the elevating arm, and thus making it possible to prevent the paper holding the upper blades to hinder the elevation thereof, or to make it jerky, due to the effect of the thickness of the paper or humidity, etc.

What is claimed is:

1. An electric punch whereby a plurality of spaced apart holes can be punched in stacked sheets of paper, comprising punching block means defining a plurality of spaced apart female punching elements and means for supporting paper in a predetermined position overlying said female punching elements, a male punching element for each female punching element movable axially downwardly into and upwardly out of the female punching element, a solenoid for each male punching element, and a plunger for each solenoid that is magnetically attracted into the solenoid upon electrical energization thereof, said punch being characterized by:

A. a plurality of elevating arms, one for each male punching element, each said elevating arm
  (1) having at one end thereof a pivotal connection with said punching block means about which the elevating arm is swingable up to and down from a defined raised position,
  (2) having at its other end a connection with one of said plungers whereby the elevating arm is swung down from said position by energization of the solenoid for the plunger, and
  (3) having intermediate its ends a connection with its male punching element whereby the latter is moved axially up and down by up and down swinging of the elevating arm;

B. a first coil spring for each of said elevating arms, each said first coil spring having a lower end engaging said punching block means and an upper end at all times engaging its elevating arm to yieldingly bias the same to said position; and C. a second coil spring for each elevating arm, each said second coil spring
  (1) being stronger than the first coil spring for its operating arm,
  (2) having a lower end engaged with said punching block means, and
  (3) being of such length that its upper end is spaced from said elevating arm when the latter is in said position but is engaged by the elevating arm as the latter swings down from said position.

2. The electric punch of claim 1 wherein said means for holding paper in a predetermined position comprises an insertion concavity in said punching block means into which paper is insertable edgewise, further characterized by:

a switching mechanism mounted on said punching block means and arranged to be actuated by insertion of paper into said insertion concavity, said switching mechanism being connected with said solenoids for energizing the same when the switching mechanism is actuated.

3. The electric punch of claim 2 wherein said switching mechanism comprises a pair of switches which are spaced from one another in the direction in which the female punching elements are spaced apart and which are connected in series with one another and said solenoids so that the solenoids will not be energized until paper in the insertion concavity has been brought to said predetermined position.

4. The electric punch of claim 2, further characterized by:

control mechanism connected between said switching mechanism and said solenoids and arranged to effect energization of the solenoids sequentially upon actuation of the switching mechanism.

* * * * *